United States Patent [19]

Christodoulou

[11] Patent Number: 4,712,312

[45] Date of Patent: Dec. 15, 1987

[54] REACTION CHAMBER CONVEYOR

[75] Inventor: Spiros Christodoulou, New Barnet, United Kingdom

[73] Assignee: Din Engineering Limited, Luton, United Kingdom

[21] Appl. No.: 885,635

[22] Filed: Jul. 15, 1986

[30] Foreign Application Priority Data

Jul. 15, 1985 [GB] United Kingdom ..... 8517798

[51] Int. Cl.[4] ..... F26B 17/10

[52] U.S. Cl. ..... 34/57 D; 34/182; 198/676; 366/316

[58] Field of Search ..... 366/316, 322; 198/676; 34/182, 57 D, 181

[56] References Cited

U.S. PATENT DOCUMENTS 1,411,199 3/1922 Wurl ..... 34/182

FOREIGN PATENT DOCUMENTS

EP0063486 10/1982 European Pat. Off. .

*Primary Examiner*—Larry I. Schwartz

*Attorney, Agent, or Firm*—Sughrue, Mion, Zinn, Macpeak and Seas

[57] ABSTRACT

A conveyor for use in a reaction chamber comprises a shaft having discs mounted therealong to provide a plurality of separate treatment zones between the discs. An opening is provided in the upstream disc of each zone and a transfer blade is associated with each opening to urge material therethrough as the conveyor is rotated. In one embodiment, the upstream disc of the second zone is provided with an additional opening such that a dose of material ejected from the first zone will be spread across the second and third zones for treatment therein and will be subsequently recombined in the fourth zone.

6 Claims, 10 Drawing Figures

REACTION CHAMBER CONVEYOR

BACKGROUND TO THE INVENTION

1. Field of the Invention

The invention relates to a conveyor for use in a reaction chamber and is particularly useful when used in a fluidised bed reaction chamber, such as is used in the roasting or drying of granular material such as coffee beans, peanuts, wheat etc.

2. Description of the Prior Art

European Pat. No. 63486 describes a fluidised bed reaction chamber in which a conveyor effectively divides the reaction chamber axially into separate zones and acts to move a dose of material successively from one zone to the next after a period of dwell in each zone. The conveyor comprises a plurality of discs spaced axially along a shaft and mounted for rotation with the shaft to provide a plurality of substantially separate zones between the discs. The conveyor co-operates with a chamber wall which has a part-cylindrical portion closely surrounding at least the lower part of the discs. Material is conveyed from one zone to the next through openings in the discs and each opening is associated with a transfer blade extending across the respective zone to urge material through the opening as the conveyor is rotated.

In the previously known conveyor each disc is provided with a single opening for passage of material therethrough and the openings in successive discs are axially aligned with one another or are successively equally circumferentially displaced such that the dwell time of material in each zone is the same and each dose of material is moved stepwise along the conveyor from one zone into the next successive zone.

SUMMARY OF THE INVENTION

It is the object of the present invention to improve upon the known conveyor by providing means whereby the dwell time of a dose of material may be varied from zone to zone and whereby a dose of material may be allowed to spread through two or more adjacent zones for treatment.

Such an arrangement provides for a greater versatility of the chamber in providing controlled treatment of material in successive zones.

In a first aspect of the invention one or more of the discs is provided with an additional opening therein such that a dose of material may spread through two or more adjacent zones for treatment.

In a second aspect of the invention at least some of the discs are provided with demountable parts such that the number of openings in any of those discs and the relative alignment of the openings in successive discs may be varied. This form of the invention not only allows for a dose of material to be spread through adjacent zones, but also allows the dwell time of the material to be varied from zone to zone.

In the previously known conveyor, the transfer blades extend radially from the outer cylindrical surface defined by rotation of the conveyor only a relatively small way towards the shaft. Because of the limited radial extent of these transfer blades some material may pass over the blades either in an upstream or downstream direction as a result of air currents generated within the chamber. Complete separation of the material in successive zones is thus not achieved and the integrity of doses of material moving through the conveyor is not maintained. This problem is particularly aggravated if the openings in successive discs are aligned or nearly aligned since a continuous axial pathway adjacent the shaft may be created. The even treatment of all material passing through the reaction chamber can therefore not be guaranteed in the prior known conveyor.

It is a preferred feature of the invention that the transfer blades extend radially from the outer cylindrical surface defined by rotation of the conveyor, substantially to the shaft of the conveyor. When the conveyor is used to convey fluidised material the possibility of material passing over the transfer blades in either direction is thus prevented and the separation of material in successive zones is substantially complete. Apart from the prevention of undesirable mixing of material between zones this improvement also enables a dose of material to be fed into the first zone of the reaction chamber behind the blade therein whilst the previous dose is being transferred by the blade into the next zone.

DETAILED DESCRIPTION OF THE INVENTION

Figure 1:
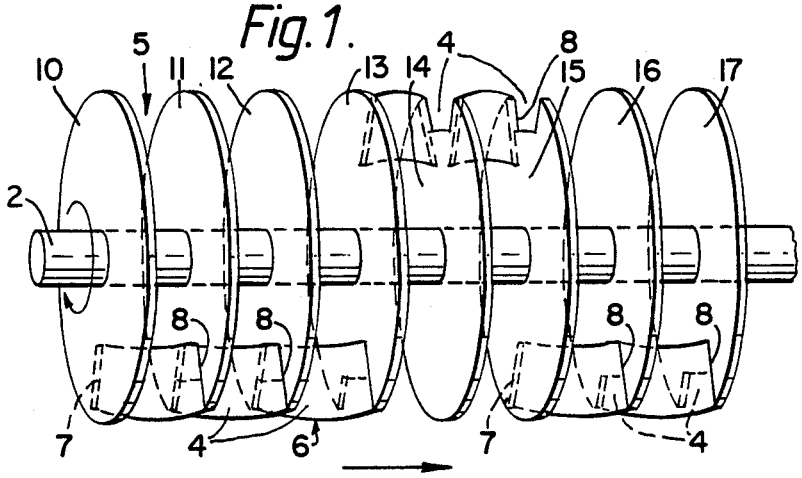
FIG. 1 is a perspective view of a conveyor removed from the reaction chamber.

In the drawings the conveyor is shown in use in a fluidised bed reaction chamber which may be vibrated to enhance both fluidisation and movement of material through the chamber.

Figure 3:
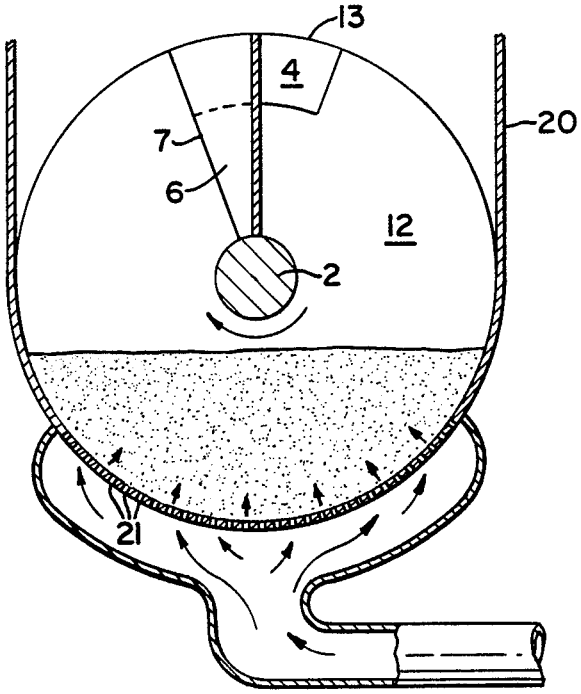
FIG. 3 is a cross-sectional view of the conveyor, drawn along line A—A in FIG. 2, located in a fluidised bed reaction chamber.
Figure 2:
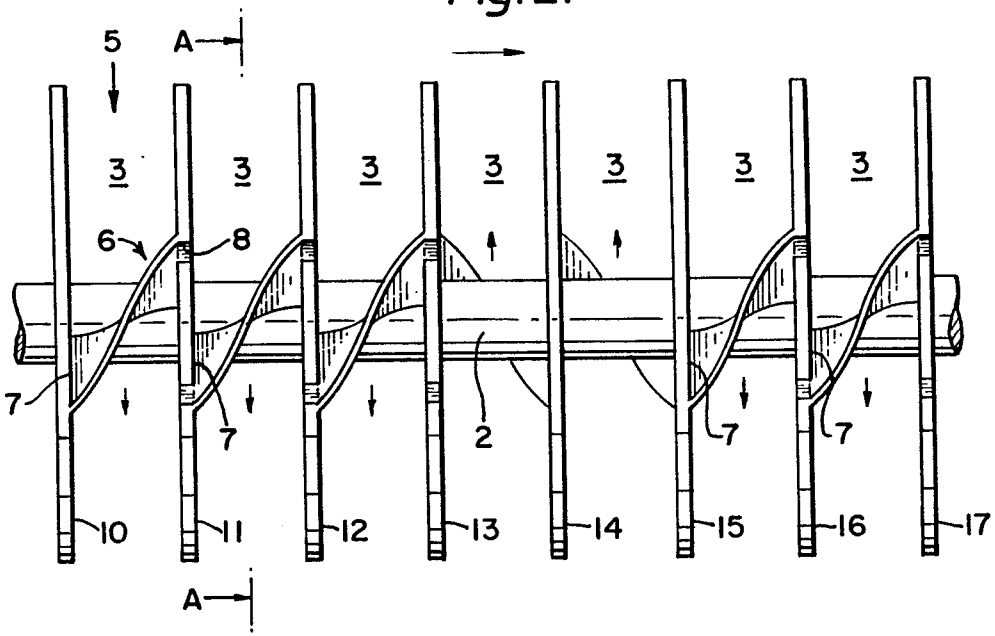
FIG. 2 is a plan view of an alternative embodiment of a conveyor.

Referring to FIGS. 1 to 3, the conveyor comprises a plurality of discs 10–17 mounted on a shaft 2 which is rotated at a selected constant speed by a drive (not shown). As shown in FIGS. 1–3 material is conveyed from left to right through the reaction chamber which is divided into a number of zones 3 by the discs which are surrounded at least over a lower portion thereof by the wall 20 of the reaction chamber as shown in FIG. 3. Fluidised material is conveyed along the reaction chamber through openings 4 which are provided in each disc except the upstream disc 10. The quantity of material supplied to the conveyor and the degree of fluidisation are controlled so that the level of material is maintained well below the shaft 2. Material is supplied (as indicated by arrow 5) to the reaction chamber directly into the zone formed between the first disc 10 and the next succeeding disc 11. In each zone, a transfer blade 6 acts to urge material through the respective opening 4 into the next succeeding zone 3 as the opening and the blade pass below the shaft.

Each transfer blade 6 trails circumferentially from the upstream disc of the zone to the trailing edge 8 of the opening in the downstream disc with which it is associated. If the circumferentially leading edges 7 of the blades are connected to the upstream discs adjacent the leading edge of the opening in the upstream discs, and the circumferential extent of the blade is equal to that of the openings, then the openings will be axially aligned. This instance is shown in FIGS. 1 and 2, in relation to discs 10–13. If two adjacent discs are arranged such that the openings therein are say 180° out of alignment, however, then the leading edge of the blade therebetween will also be 180° out of alignment with the leading edge of the opening in the upstream disc. An example of this is shown in FIGS. 1 and 2, where disc 13 and disc 14 are 180° out of alignment with one another and discs 15 and 16 are 180° out of alignment with one another. The plates may be helical in structure as shown in FIGS. 2 and 3 or may be substantially flat as shown in FIG. 1. If flat plates are used any gaps between the radial inner edge of the plate and the shaft should be closed by fillets (not shown) suitably angled to prevent material passing therethrough.

A dose of material delivered into the first zone of the reaction chamber remains in that zone until the blade spanning discs 10 and 11 passes it through the opening in the disc 11 and into the next downstream zone. The dose will remain in the second zone during substantially one complete revolution of the shaft 2 after which time it is moved into the zone defined between discs 12 and 13. This sequence is repeated until the dose is moved into the zone between discs 13 and 14. Because of the 180° mis-alignment of the openings in discs 13 and 14, the dose will be moved on from ths zone after substantially only one half revolution of the shaft. This situation will also occur in the zone between discs 15 and 16 since disc 16 is again 180° out of alignment with disc 15. If the conveyor as exemplified in FIGS. 1 or 2 is driven at a constant speed, a dose of material delivered into the first zone of the reaction chamber just behind the blade therein will spend 1 unit of time in each of the first three zones, 0.5 units of time in the fourth zone, 1 unit of time in the fifth zone, 0.5 units in the sixth zone, and one unit of time in the seventh zone. By selectively varying the relative alignment of the openings in successive discs the period of time which a dose of material spends in any one zone can be controlled. The maximum duration of dwell in any one zone is of course equivalent to one revolution of the shaft 2.

Although not shown in the drawings, the discs may be provided with demountable parts such that the number of openings in any one disc and the relative alignment of the openings in successive discs may be varied. Thus each disc may, for example, have two openings formed therein and may have one of those openings closed by a demountable plate. Mounting points will also be provided for mounting transfer blades on the discs as necessary and in accordance with the openings which are provided.

As described and shown with particular reference to FIG. 3, the conveyor is particularly useful in a fluidised bed reaction chamber having a wall 20 which has a part-cylindrical portion closely surrounding the lower part of the discs 10–17. The wall 20 has a plurality of perforations 21 whereby fluidising air or other materials may be delivered into the reaction chamber. Because the reaction chamber is effectively divided along its axial extent into separate zones, it is possible for each zone to be supplied and controlled individually and in combination with the ability to vary the dwell time of material in any one zone relative to other zones, this facility lends a great versatility to the apparatus. For example, it would be possible for a dose of material to be subjected to rapid cooling in one zone over a period of time equivalent to, say, only one quarter of a revolution of the shaft 2.

Figure 4:
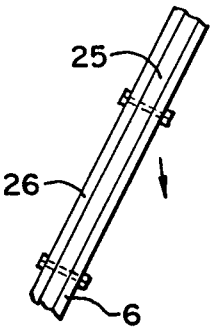
FIG. 4 is a diagrammatic view of part of the outer edge of a blade of a conveyor.

To ensure complete transfer of a dose of material from one zone to the next it is important that there is no substantial space left between the radial inner edge of each blade 6 and the shaft 2. In the example shown in FIGS. 2 and 3 there is no space left since the radially inner edge of the blade lies along the shaft 2. In practice this may not be possible due to the necessary mounting arrangements for the discs on the shaft. In any event there should be no substantial gap left open between the radially inner extent of the blades and the shaft through which material might pass. The radial outer edges of the blades 6 are carefully constructed to sweep smoothly against the curved portion of the wall 20. In one embodiment, as shown in Figure 4, the radial outer edges of the blades 6 are thickened by the provision of strips 25 and 26 which are suitably fitted thereto. The strip 25 is suitably made of PTFE. This thickening of the effective outer edge of each blade causes air passing into the respective zone through perforations 21 to be squeezed against the thickened edge and directed axially in both directions. This squeezing has a beneficial effect in substantially reducing the amount of material which is trapped and crushed between the wall 20 and the blades 6.

Although the blades 6 as shown in FIGS. 1–3 are of substantially equal circumferential extent to the openings 4 in the discs, this arrangement is by no means essential and has been selected only for ease of representation and understanding. It is important that the angle of the blade as it acts on the material is not too shallow and thus, given an ideal angle of say 45°, the circumferential extent of any one plate is decided mainly by the axial spacing of the respective discs. Since the openings 4 are advantageously kept to a minimum dimension it will often be the case that the blades have a greater circumferential extent than the openings. The axial spacing between discs may also be varied from zone to zone.

Figure 6A:
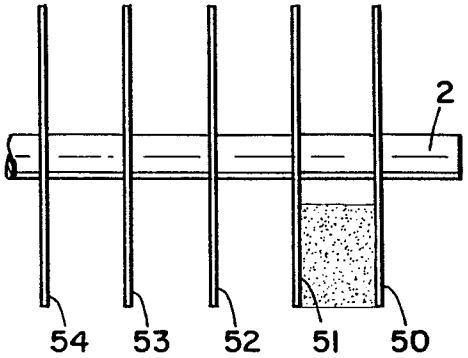
FIGS. 5*a–c* and 6*a–c* show an alternative embodiment in three successive positions of rotation.
Figure 5A:
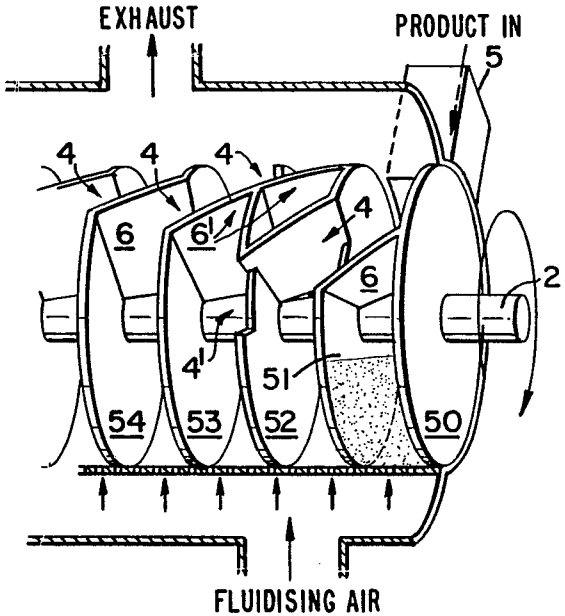
Figure 6B:
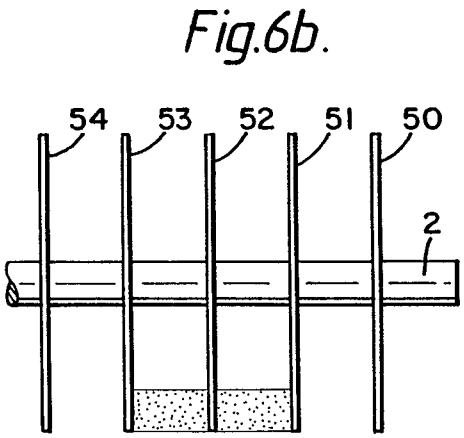
Figure 5B:
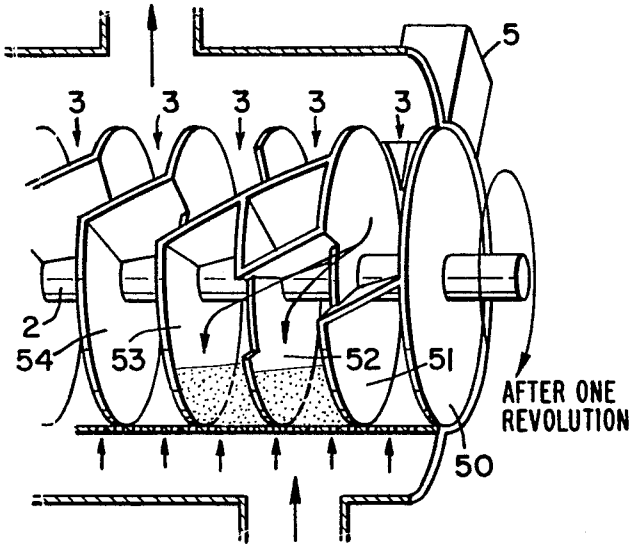
Figure 6C:
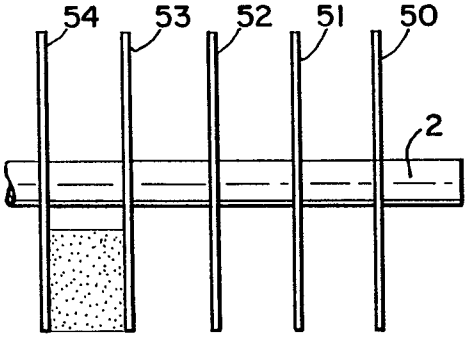
Figure 5C:
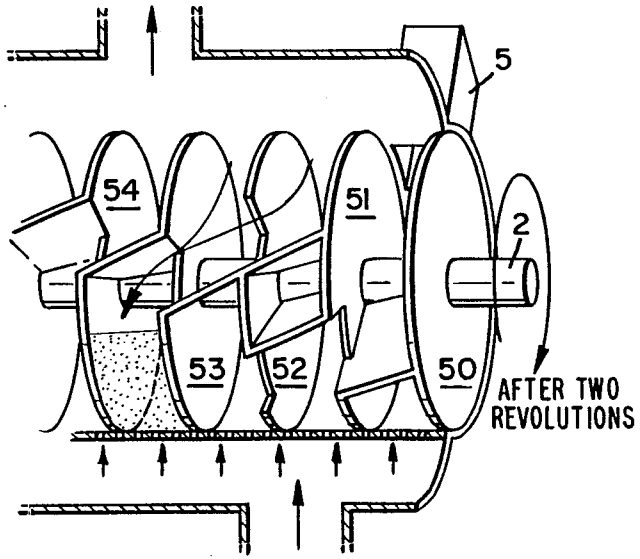

FIGS. 5*a–c* and 6*a–c* show an embodiment having discs 50–54 in which the disc 52 is provided with two openings 4, 4' such that a dose of material is able to spread between two adjacent zones and to re-combine in a subsequent zone. As shown in FIGS. 5*a* and 6*a*, a dose of material is charged into the first upstream zone behind the transfer plate in the first zone and subsequently ejected from the first zone through the opening 4 therein. Because of the opening 4' in disc 52, however, the dose ejected from the first zone is able to spread across the second and third zones—see FIGS. 5*b* and 6*b*. After a further rotation of the conveyor, the material is ejected from the second and third zones by an extended transfer plate 6' and is re-combined in the fourth zone—see FIGS. 5*c* and 6*c*.

The change in operation of the conveyor over the second and third zones is brought about first by the addition of opening 4' in disc 52 immediately behind the transfer blade of the second zone which allows the dose to spread across the second and third zones as it is discharged from the first zone. Secondly, the opening 4 in disc 52 is advanced to a position immediately ahead of the transfer blade of the third zone, and thirdly, the transfer blade 6' of the third zone is extended across the second zone such that material in the second and third zones is ejected thereby into the fourth zone.

It will be seen from the above that by providing each disc of a conveyor with one or more additional openings which may be selectively opened, it will be possible to convert a conveyor having a disc spacing of say 50 cm into a conveyor which operates in the manner of a conveyor in which some of all of the discs are spaced by 100 cm, 150 cm, or even 200 cm.

I claim:

1. A fluidized bed reaction chamber having a perforated, part-cylindrical lower wall and a conveyor for conveying fluidized material through the reaction chamber, the conveyor comprising a shaft, a plurality of discs spaced axially along the shaft and mounted for rotation with the shaft to provide a plurality of substantially separate zones between the discs, a first opening having a leading edge and a trailing edge and defined in an upstream disc of each zone to allow for the passage of doses of fluidized material from zone to zone, and a transfer blade means associated with each opening and extending across the respective zone for urging fluidized material through the opening as the conveyor is rotated; wherein one or more of the discs is provided with a second opening disposed substantially axially opposite the opening in a preceding disc for spreading a dose of material through two or more adjacent zones for treatment during one rotation of the conveyor before being moved to the next succeeding zone.

2. A conveyor for use in a reaction chamber comprising a shaft, a plurality of discs spaced axially along the shaft and mounted for rotation with the shaft to provide a plurality of substantially separate zones between the discs, an opening in the upstream disc of each zone to allow for the passage of doses of material from zone to zone, and a transfer blade associated with each opening and extending across the respective zone to urge material through the opening as the conveyor is rotated; wherein at least some of the discs are provided with demountable parts such that the number of openings in any of those discs and the relative alignment of the openings in successive discs may be varied.

3. A conveyor as claimed in claim 2 wherein at least some of the discs have two openings therein and wherein demountable plates are provided for selectively closing the openings.

4. A conveyor as claimed in any preceding claim wherein each of the transfer blades extends radially from an outer cylindrical surface defined by rotation of the conveyor, substantially to the shaft of the conveyor.

5. A reaction chamber as claimed in claim 1 wherein each of the transfer blades extends radially from an outer cylindrical surface defined by rotation of the conveyor, substantially to the shaft of the conveyor.

6. A reaction chamber as recited in claim 1 wherein said transfer blade means extends from an upstream disc to the leading edge of said second opening in a downstream disc to allow the material to spread across two or more adjacent zones as it is ejected from a first zone.

* * * * *